United States Patent [19]

Alessio et al.

[11] 4,280,542

[45] Jul. 28, 1981

[54] CUTTERHEAD FOR A PORTABLE POWER PLANER

[75] Inventors: Lorenzo E. Alessio, Cairoli; Giuseppe Cuneo, Lorentuis, both of Italy

[73] Assignee: Black & Decker Inc., Newark, Del.

[21] Appl. No.: 73,767

[22] Filed: Oct. 3, 1979

[30] Foreign Application Priority Data

Sep. 8, 1978 [IT] Italy ..... 27473 A/78

[51] Int. Cl.[3] ..... B27C 1/02; B27G 13/04

[52] U.S. Cl. ..... 144/230; 144/117 C; 144/218; 407/89; 407/90; 407/113

[58] Field of Search ..... 145/4, 4.1, 4.2; 144/114 R, 115, 117 C, 218, 227, 230, 241; 407/49, 46, 50, 64, 65, 89, 90, 91, 107, 108, 110, 113

[56] References Cited

U.S. PATENT DOCUMENTS

| | | | |
|---|---|---|---|
| 644,851 | 3/1900 | Dyer | 144/227 |
| 864,463 | 8/1907 | Haber | 144/227 |
| 1,490,745 | 4/1924 | Johnston | 144/227 |
| 1,724,497 | 8/1929 | Mehl | 407/110 |
| 2,221,458 | 11/1940 | Sacrey | 407/65 |
| 2,550,949 | 5/1951 | Weidner | 407/110 |
| 3,017,912 | 1/1962 | Sybertz et al. . | |
| 3,163,062 | 12/1964 | Schultz | 407/64 |
| 3,591,305 | 7/1971 | Aichhorn | 144/230 |

FOREIGN PATENT DOCUMENTS 1028068 5/1966 United Kingdom .

*Primary Examiner*—W. D. Bray

*Attorney, Agent, or Firm*—Walter Ottesen; Leonard Bloom; Edward D. Murphy

[57] ABSTRACT

The invention is directed to a cutterhead for a portable power planer. The cutterhead includes a cylindrical body having a substantially cylindrical surface and defining a rotational axis about which the cylindrical body rotates during normal operation of the power planer. A solid elongated cutting member is provided and has a channel formed therein to define at least two cutting edges. The cylindrical body has an elongated recess formed therein for holding the cutting member. The recess extends in a direction parallel to the rotational axis of the cutterhead and defines a longitudinal aperture in the surface for accommodating one of the cutting edges. The recess has a recess wall extending inwardly away from the aperture to surround and hold the cutting member against the centrifugal forces acting thereupon during the rotation of the cylindrical body. Positioning pins arranged in the cylindrical body engage the cutting bar to angularly fix the cutting member so that the one cutting edge penetrates the aperture at a predetermined angle of elevation with respect to the surface of the cylindrical body. A screw mounted in the cylindrical body directly engages the cutting member to tightly seat the latter against the recess wall.

14 Claims, 6 Drawing Figures

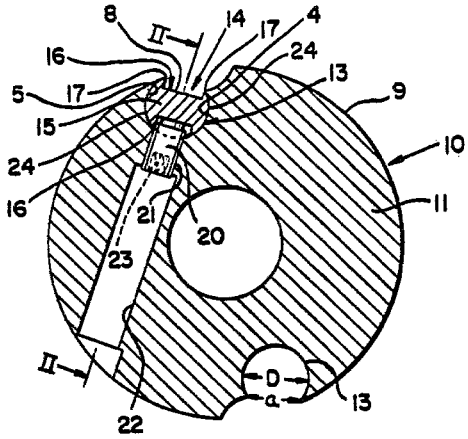
FIG. 3
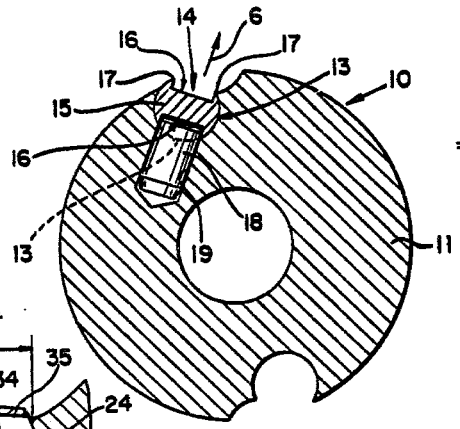
FIG. 4
FIG. 6
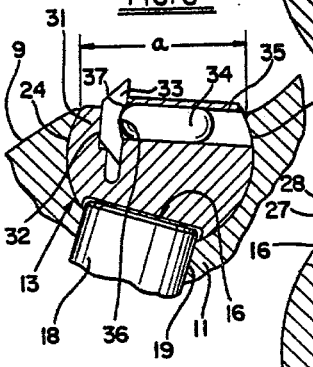
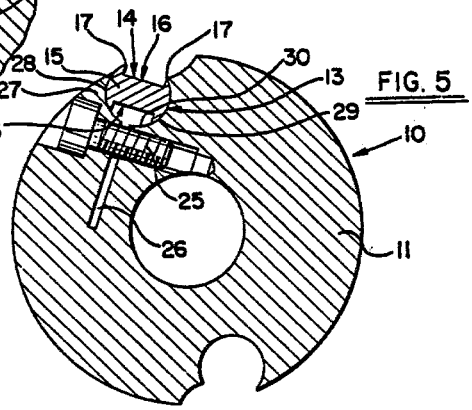
FIG. 5

CUTTERHEAD FOR A PORTABLE POWER PLANER

BACKGROUND OF THE INVENTION

The invention relates to a cutterhead for a portable power planer. The cutterhead of a portable power planer is made up of a substantially cylindrical body rotatable about its longitudinal axis and capable of accommodating one or more cutting blades in such a way that the cutting edge of each blade projects from the cylindrical external surface of the cylindrical body substantially along a plane tangent to this surface.

As a rule, two blades are mounted at diametrically opposite positions within groove-like seats machined in the cylindrical body and extending inwardly from the cylindrical surface thereof. The two blades are part of cutting assemblies arranged in the groove-like seats and these cutting assemblies must satisfy well defined requirements.

Above all else and because of the high rotational speeds at which the cutterhead is driven, it must be possible to firmly fasten each blade to withstand the substantial workloads to which it is subjected.

In addition, because the cutting edge of each blade wears down with use, its position within its seat must be adjustable to cause the cutting edge of the blade to project above cylindrical surface of the cutterhead after each sharpening by the required amount while at the same time setting the blade so that its edge is parallel to this surface.

It is readily apparent that while the firm fastening of the blade does not constitute a significant problem, it is far more difficult to provide an arrangement for positioning the blade that is so simple as to be readily utilized even by persons who are not necessarily experts and who frequently use tools of this type. Further, it is desirable that the arrangement for positioning the cutting member be simple and economical. Also, the means for tightly seating the cutting member in the cylindrical body should be of simple configuration and easy to set.

SUMMARY OF THE INVENTION

In view of the foregoing, it is an object of the instant invention to provide a cutterhead for power planers wherein the need for adjusting the position of the cutting member in its seat is obviated altogether and wherein the only step required of the operator after inserting the blade in the cutterhead is that of the fastening the cutting member.

It is another object of the invention to provide a cutterhead for a portable power planer wherein the cylindrical body of the cutterhead is configured to hold the cutting member against centrifugal force and only a screw is needed for tightly seating the cutting member in place in the cylindrical body.

It is another object of the invention to provide a cutterhead wherein the cutting member is angularly positioned simply and inexpensively.

The foregoing objects are realized with the cutterhead according to the invention which includes a substantially cylindrical body having a substantially cylindrical surface and defining a longitudinal axis. A groove-like seat is formed in the cylindrical body and the seat extends in a direction parallel to the longitudinal axis so as to define a longitudinal aperture in the surface of the body likewise parallel to said axis. A solid cutting member is accommodated in the seat and has a channel formed therein to define at least two cutting edges. The cutting member is inserted in the seat so as to selectively cause one of the cutting edges to project beyond the surface of the cylindrical body. Angular positioning means are provided for angularly fixing the solid member so that the selected one of the cutting edges penetrates the longitudinal aperture of the seat at a predetermined angle of elevation with respect to the surface of the body.

According to a preferred embodiment of the invention, the cutting member is in the form of a cylindrical bar into which there have been machined two diametrically opposite, longitudinally extending channels defining four cutting edges. The channels are so machined into the bar that the four cutting edges are symmetrically positioned with respect to the axes of symmetry of the bar which hereinafter is referred to as the cutting member. The cutting member has rounded outer surfaces between the channels and these rounded surfaces define cylindrical surface portions. The seat has a partially cylindrical shape and is open at its longitudinal ends. The seat also defines a longitudinal aperture extending parallel to the longitudinal axis of the cylindrical body. The longitudinal aperture has a width less than the diameter of the seat. The seat is a recess in the cylindrical body and has a recess wall extending inwardly away from the longitudinal aperture to surround and hold the cutting member against centrifugal forces acting thereupon during rotation of the cylindrical body. The recess wall defines a curved surface having a curvature corresponding substantially to the curvature of the rounded outer surfaces of the cutting member. The diameter of the seat can preferably correspond to the diameter of the cutting member measured at the above-mentioned rounded outer surfaces thereof. The seat is provided with angular positioning means for positioning the cutting member and screw means serve to lock the cutting member in place.

It is still another object of the invention to provide a cutterhead adapted to receive a blade holder so that the blade holder is clamped and tightly held in such a manner that the cutting blade too is tightly held without requiring any additional holding devices.

This object of the invention is achieved by providing a blade holder which is adapted to be seated in the recess seat of the cylindrical body of the cutterhead. The blade holder has a slot formed therein for receiving a flat cutting blade. Angular positioning means angularly fix the blade holder in the recess seat so that the cutting blade penetrates the aperture of the recess at a predetermined angle of elevation with respect to the cylindrical surface of the cylindrical body. A screw mounted in the cylindrical body directly engages the blade holder to tightly seat the latter against the recess wall and to clamp the cutting blade in the blade holder.

BRIEF DESCRIPTION OF THE DRAWING

The foregoing objects and advantages of the invention will become more apparent from a consideration of the detailed description to follow in conjunction with the drawing annexed hereto wherein:

FIG. 3 is a section taken along line III—III of FIG. 2 and illustrates the clamping member for clamping the cutting member tightly in its seat;

FIG. 4 is a section taken along line IV—IV of FIG. 2 and illustrates the angular positioning means for angularly positioning the cutting member so that one the cutting edges thereof is positioned at a predetermined angle with respect to the substantially cylindrical surface of the cutterhead;

FIG. 5 is a section view illustrating an another embodiment of the invention wherein the cutterhead is provided with an alternate arrangement for clamping the cutting member in the cutterhead; and, FIG. 6 is a fragmentary view showing still a further embodiment of the invention wherein a blade holder is held within the cutterhead.

DESCRIPTION OF THE PREFERRED EMBODIMENTS OF THE INVENTION

Figure 1:
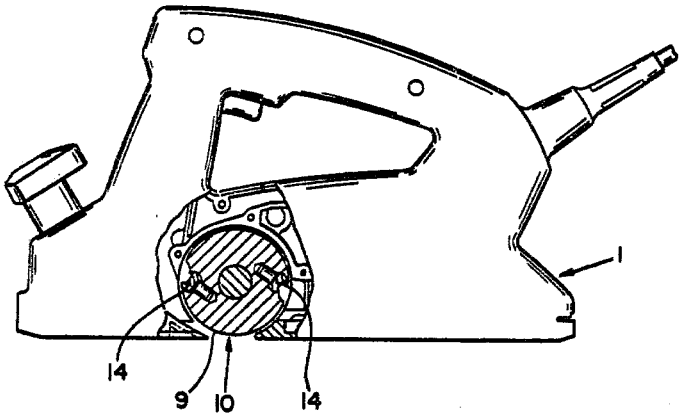
FIG. 1 is an elevation view partially in section, of a portable power planer showing the cutterhead according to the invention.

FIG. 1 illustrates a portable power planer equipped with a cutterhead 10 according to the invention. The cutterhead 10 is rotatably mounted in the planer 1 and carries cutting members 14 for planing the surface of a workpiece such as wood.

Figure 2:
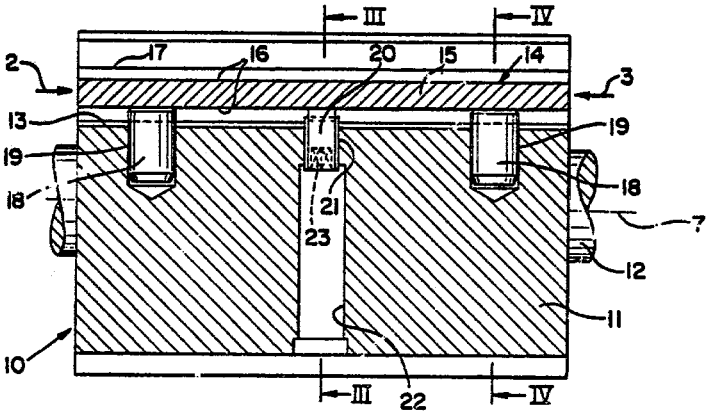
FIG. 2 is a longitudinal section taken along line II—II of FIG. 3 and illustrates a cutterhead according to a preferred embodiment of the invention.

With reference to FIGS. 2 to 4, the cutterhead 10 includes a cylindrical body 11 which is constructed to rotate at high speeds on the shaft 12 about the rotational axis 7.

The cylindrical body 11 is provided with two longitudinal seats 13 that extend inwardly from the surface 9. The seats 13 are formed in the body 11 and extend through the entire longitudinal length thereof as shown. The seats 13 are of a partially cylindrical section and define a longitudinal aperture "a" having a width less than the diameter "D" thereof (FIG. 3). If desired, the body 11 can be made by extruding aluminum with the seats 13 being formed therein during the extrusion process. The extruded aluminum member can then be cut into segments to make a plurality of cylindrical bodies 11.

Cutting means in the form of four-edged cutting member 14 can be laterally inserted into seat 13 in either one of the two directions as indicated by the arrows 2 and 3 of FIG. 2. The cutting members are preferably made from sintered hard steel.

The cutting member 14 is shaped from a cylindrical member by machining therein two identical channels 16 of rectangular section which extend longitudinally in the direction of the longitudinal axis of the cutting member. The channels 16 are arranged diametrically opposite each other and have bases 8 which extend crosswise along parallel chords and are almost equal to the diameter of the cutting member 14 measured at the rounded outer surfaces 4 and 5 between channels 16; in this way, four cutting edges 17 are defined in respective positions symmetrical with respect to the longitudinal axis of the cutting bar 14. The edges 17 are positioned opposite one another which, when appropriately sharpened, form four interchangeable cutting edges 17 of the cutting member 14. The cylindrical member that forms the core of the cutting member 14 has a diameter corresponding substantially to that of its seat 13 into which it inserted. As can be seen in FIGS. 3 and 4, the channels 16 are oppositely disposed and defined by relieved portions in the outer periphery of the cutting member 14.

The correct angular position of the cutting member 14 inside the seat 13 whereat one of the cutting edges 17 is at a predetermined angle of elevation with respect to the surface 9 is defined automatically by a pair of pins 18. With the angular position of the cutting member 14 defined by the pins 18, one of the cutting edges 17 projects tangentially from the external surface 9 of the cylindrical body 11. Each of the pins 18 is secured in a corresponding seat 19 of the cylindrical body 11 and has an end portion of predetermined length that projects into the seat 13 so as to mate freely with one of the two machined channels 16 of the cutting member 14 into its seat. Accordingly, to place the cutting member 14 into its seat 13, the cutting member 14 is merely positioned by the operator so that one of the channels 16 is in alignment with the pins 18 and thereafter is inserted laterally in the direction of one of the arrows 2 or 3 as described above in connection with FIG. 2.

With the cutting member 14 firmly in place, it cannot emerge frontally from its seat 13 in the direction of the arrow 6 of FIG. 4 in response to the centrifugal force developed during rotation of the cutterhead 10. This is true because the seat 13 is a recess having a recess wall 24 which extends inwardly into the cylindrical body 11 away from the aperture "a" to surround and hold the cutting member 14 against the centrifugal forces. In this connection, it is noted that the diameter "D" of the seat 13 is greater than the width "a" of the aperture.

To prevent any possibility of an unwanted lateral dislodgement of the cutting member 14 from its seat 13, the cutting member 14 is firmly locked in place by means of at least one securing screw 20. If only one such screw 20 is provided, it is preferably arranged centrally within the cylindrical body 11 between the alignment pins 18. The screw 20 threadably engages a threaded bore 21 coaxial with a larger diameter counter-bore 22 through which access to the recessed head 23 of the screw 20 can be had with an Allen wrench. The screw 20 acts upon the base 8 of one of the two channels 16 and forces the opposite cylindrical surface portions 4 and 5 of the cutting member 14 directly against the wall 24 of the seat 13.

Once the operator has inserted the cutting member 14 into its seat 13 as described above, there is no longer any need to perform a difficult registering operation to position the selected cutting edge 17 into its proper operating position. Proper positioning of the cutting member 14 is achieved with an economical and simple arrangement of the pins 18 coacting with channels 16. This arrangement makes it unnecessary to provide for carefully machined surfaces in the cylindrical body of cutterhead against which the cutting member is pressed by means of a holding piece as is taught in the prior art.

Referring again to the drawing, when a cutting edge 17 has been worn down, the operator merely substitutes therefor another one of the edges 17 until all four cutting edges have been used up, after which the cutting member 14 can be discarded. The cutting edge 17 is changed by first releasing the screw 20, then laterally withdrawing the cutting member 14 from its seat 13 and rotating the same about its longitudinal axis in such a way that a new cutting edge 17 will project above the surface 9. The cutting member 14 is again inserted into the seat 13 so that the new cutting edge 17 is in cutting position. The screw 20 is then tightened.

FIG. 5 is an alternate embodiment of the cutterhead of the invention in which the cutting member 14 is fastened in its seat by means of a screw 25 that can be tightened to clamp the walls of the seat recess 13 tightly on the cutting member 14. The wall portion 27 can yield in response to the screw 25 because of the slot 26 which divides the recess wall into two mutually adjacent wall surfaces 28 and 29. The slot 26 extends throughout the length of the seat recess 30 and is formed in the cylindrical body 11 to a predetermined depth along the median plane of the cutting edges 17 of the cutting member 14.

FIG. 6 discloses still another embodiment of the invention wherein a blade holder 31 is inserted in the seat recess 13 of the cylindrical body 11. The blade holder 31 has a slot 32 formed therein for receiving a cutting blade 33. A pin 34 is pressfitted into a bore 35 of the blade holder 31 and has a rounded end 36 which engages with an arcuate recess 37 formed in the blade 33.

The recess 13 has a recess wall 24 which extends inwardly away from the aperture "a" to surround and hold the blade holder 31 against centrifugal forces acting thereupon during rotation of the cylindrical body 11 about its rotational axis.

The pin 18 angularly fixes the blade holder 31 so that the cutting blade 33 penetrates the aperture "a" at a predetermined angle of elevation with respect to the surface 9 of the body 11. A screw is mounted in the cylindrical body 11 as shown FIG. 3 for directly engaging the blade holder 31 to tightly seat the latter against the recess wall 24 and to clamp the cutting blade 33 in blade holder 31.

Should the screw 20 become loose during operation, the blade holder 31 will still be held from flying out radially in response to centrifugal force by the recess wall 24. Although a loosening of the screw 20 would also cause the blade 33 to become loose, it too will be held against centrifugal force by the rounded end 36 of pin 34 in engagement with the blade 33 at its arcuate recess 37.

What is claimed is:

1. A cutterhead for a portable power planer comprising:

a cylindrical body having a substantially cylindrical surface and defining a longitudinal axis;

seat means formed in said body and extending in a direction parallel to said axis so as to define a longitudinal aperture in said surface likewise parallel to said axis;

a cutting member defining a longitudinal axis and having two channels formed therein, said channels being oppositely disposed and defined by releived portions in the outer periphery of said cutting member, said channels extending parallel to said longitudinal axis, said cutting member having outer surfaces between said channels and being releasably insertable in said seat means, one of said channels defining at least two cutting edges and the other of said channels angularly positioning said cutting member to selectively cause one of said cutting edges to project beyond said cylindrical surface; and angular positioning means projecting into said seat means and engaging in said other channel for angularly fixing said cutting member so that the selected cutting edge penetrates said aperture at a predetermined angle of elevation with respect to said surface.

2. A cutterhead for a portable power planer comprising:

a cylindrical body having a substantially cylindrical surface and defining a rotational axis about which said cylindrical body rotates during normal operation of the power planer;

a solid elongated cutting member having two channels formed therein to define at least two cutting edges, said channels being oppositely disposed and defined by releived portions in the outer periphery of said cutting member;

said cylindrical body having an elongated recess formed therein for holding said cutting member;

said recess extending in a direction parallel to said axis and defining a longitudinal aperture in said surface for selectively accommodating any one of said cutting edges, said recess having a recess wall extending inwardly away from said aperture to surround and hold said cutting member against the centrifugal forces acting thereupon during the rotation of said cylindrical body; and, positioning means projecting into said recess and being angularly disposed, said positioning means engaging in one of said channels for angularly fixing said cutting member so that the cutting edge selected penetrates said aperture at a predetermined angle of elevation with respect to said surface.

3. A cutterhead for a portable power planer comprising:

a cylindrical body having a substantially cylindrical surface and defining a rotational axis about which said cylindrical body rotates during normal operation of the power planer;

a solid elongated cutting member defining a longitudinal axis and having two channels formed therein to define four cutting edges extending parallel to said longitudinal axis, said cutting member having rounded outer surfaces between said channels;

said cylindrical body having an elongated recess formed therein for holding said cutting member;

said recess extending in a direction parallel to said axis and defining a longitudinal aperture in said surface for accommodating one of said cutting edges, said recess having a recess wall extending inwardly away from said aperture to surround and hold said cutting member against the centrifugal forces acting thereupon during the rotation of said cylindrical body, and said recess wall defining a curved surface having a curvature corresponding substantially to the curvature of said rounded surfaces;

angular positioning means for angularly fixing said cutting member so that said one cutting edge penetrates said aperture at a predetermined angle of elevation with respect to said surface, and said angular positioning means including two pins projecting into said recess for engaging said cutting member in one of said channels thereby positioning said one edge at said predetermined angle; and, a screw threadably mounted in said cylindrical body for advancing into said recess and directly engaging said cutting member to tightly seat and clamp said cutting member at its rounded outer surfaces against said curved surface of said recess wall.

4. The cutterhead of claim 3:

said recess being open at least at one of its longitudinal ends to permit lateral insertion of said cutting member therein; and, said curved surface defined by said recess wall being of cylindrical configuration and having a diameter greater than the width of said aperture.

5. A cutterhead for a portable power planer comprising:

a cylindrical body having a substantially cylindrical surface and defining a rotational axis about which said cylindrical body rotates during normal operation of the power planer;

a solid elongated cutting member having two channels formed therein to define four cutting edges any one of which can be selected for cutting;

said cylindrical body having an elongated recess formed therein for holding said cutting member;

said recess defining a longitudinal aperture in said surface for accommodating the selected one of said cutting edges, said recess having a recess wall extending inwardly away from said aperture to surround and hold said cutting member against the centrifugal forces acting thereupon during the rotation of said cylindrical body;

said cutting member being positioned in said recess so that said selected cutting edge penetrates said aperture at a predetermined angle of elevation with respect to said surface;

said cylindrical body having a slot formed therein at the bottom of said recess thereby dividing said recess wall into two mutually adjacent wall surfaces, each of said wall surfaces extending from said slot to said aperture; and, positioning means projecting into said recess and being angularly disposed, said positioning means engaging said cutting member in one of said channels thereby angularly positioning said cutting member so that said selected cutting edge penetrates said aperture at said predetermined angle.

6. The cutterhead of claim 5, wherein said positioning means comprises two pins engaging in said one of said channels.

7. A cutterhead for a portable power planer comprising:

a cylindrical body having a substantially cylindrical surface defining a rotational axis about which said cylindrical body rotates during normal operation of the power planer;

a blade holder having a slot formed therein for receiving a cutting blade, and a separate channel formed therein extending parallel to said rotational axis;

said cylindrical body having an elongated recess formed therein for holding said blade holder;

said recess extending in a direction parallel to said axis and defining a longitudinal aperture in said surface for accommodating the cutting blade;

said recess having a recess wall extending inwardly away from said aperture to surround and hold said blade holder against the centrifugal forces acting thereupon during the rotation of said cylindrical body about said rotational axis;

positioning means projecting into said recess and being angularly disposed, said positioning means engaging said channel for angularly fixing said blade holder so that the cutting blade penetrates said aperture at a predetermined angle of elevation with respect to said surface; and, screw means mounted in said cylindrical body for directly engaging said blade holder to tightly seat the latter against said recess wall and to clamp said cutting blade in said blade holder.

8. A cutterhead for a portable power planer comprising:

a cylindrical body having a substantially cylindrical surface defining a rotational axis about which said cylindrical body rotates during normal operation of the power planer;

a blade holder having a slot formed therein for receiving a cutting blade, said blade holder being an elongated member defining a longitudinal axis and having a channel formed therein to extend in the direction of said longitudinal axis;

said cylindrical body having an elongated recess formed therein for holding said blade holder;

said recess extending in a direction parallel to said axis and defining a longitudinal aperture in said surface for accommodating the cutting blade;

said recess having a recess wall extending inwardly away from said aperture to surround and hold said blade holder against the centrifugal forces acting thereupon during the rotation of said cylindrical body about said rotational axis;

angular positioning means, for angularly fixing said blade holder so that the cutting blade penetrates said aperture at a predetermined angle of elevation with respect to said surface, and including two pins projecting into said recess for engaging said blade holder in said channel thereof thereby positioning said blade holder so that the cutting blade penetrates said aperture at said predetermined angle; and, a screw threadably mounted in said cylindrical body to advance into said recess and directly engage said blade holder to develop a clamping force to tightly seat said blade holder against said recess wall and clamp said cutting blade in said blade holder.

9. The cutterhead of claim 8:

said cylindrical body having a bore formed therein communicating with said recess; and, said screw being threadably mounted in said bore.

10. A cutterhead for a portable power planer, comprising:

a cylindrical body having a substantially cylindrical surface and defining a longitudinal axis about which said cylindrical body rotates during normal operation of the power planer, and having a recess formed therein extending in a direction parallel to said axis so as to define a longitudinal aperture in said surface parallel to said axis;

a solid elongated cutting member having two channels formed therein extending parallel to said axis and defining at least one cutting edge, said cutting member being disposed in said recess with said cutting edge projecting beyond said surface, and said cutting member being slidably insertable in and withdrawable from said recess in a direction parallel to said axis;

positioning means projecting into said recess in a predetermined fixed direction, said positioning means engaging in one of said channels with the other channel defining said cutting edge whereby said cutting edge is caused to penetrate said aperture at a predetermined angle of elevation with respect to said surface; and said one channel having at least one end open to enable said one channel to slidably engage said positioning means as said cutting member is slidably inserted in and withdrawn from said recess in said direction parallel to said axis.

11. The cutterhead claimed in claim 10, wherein said two channels define at least two cutting edges either of which can be selected to project beyond said surface.

12. The cutterhead claimed in claim 11, wherein said two channels define four cutting edges any one of which can be selected to project beyond said surface.

13. The cutterhead claimed in claim 10, wherein said positioning means comprises at least one pin secured in said cylindrical body.

14. The cutterhead claimed in claim 13, further comprising a screw threadably mounted in said cylindrical body and engaging in said one channel for releasably clamping said cutting member in said recess.

* * * * *